US005273005A

United States Patent [19]

Philo et al.

[11] Patent Number: 5,273,005

[45] Date of Patent: Dec. 28, 1993

[54] ENLARGED SHAFT ROLLER LIFTER WITH RETENTION MEANS

[75] Inventors: Charles M. Philo, Jenison; Philip E. Lenhart, Dorr; Mark E. Kaminski, Grand Rapids, all of Mich.; Donald E. Wilcox, Rochester, N.Y.

[73] Assignee: General Motors Corporation, Detroit, Mich.

[21] Appl. No.: 29,793

[22] Filed: Mar. 11, 1993

[51] Int. Cl.[5] ..... F01L 1/14

[52] U.S. Cl. ..... 123/90.5; 123/90.55; 74/569

[58] Field of Search ..... 123/90.48, 90.49, 90.50, 123/90.51, 90.55; 74/569

[56] References Cited

U.S. PATENT DOCUMENTS

| | | | |
|---|---|---|---|
| 1,802,330 | 4/1931 | Boland | 123/90.5 |
| 2,735,313 | 2/1956 | Dickson | 74/569 |
| 3,628,514 | 12/1971 | Phillips | 123/90.48 |
| 4,231,267 | 11/1980 | Van Slooten | 74/569 |
| 4,361,120 | 11/1982 | Kueny | 123/90.55 |
| 4,406,257 | 9/1983 | Keske et al. | 123/90.48 |
| 4,607,599 | 8/1986 | Buente et al. | 123/90.5 |
| 4,708,102 | 11/1987 | Schmid | 123/90.35 |
| 4,793,295 | 12/1988 | Downing | 123/90.5 |
| 4,807,575 | 2/1989 | Litwinchuk et al. | 123/90.55 |
| 4,846,121 | 7/1989 | Galaniuk | 123/90.48 |
| 4,876,994 | 10/1989 | Speil et al. | 123/90.5 |
| 5,054,440 | 10/1991 | Kadokawa | 123/90.5 |
| 5,099,807 | 3/1992 | Devine | 123/90.5 |
| 5,127,374 | 7/1992 | Morel, Jr. et al. | 123/90.35 |

FOREIGN PATENT DOCUMENTS

| | | | |
|---|---|---|---|
| 2340074 | 2/1975 | Fed. Rep. of Germany | 123/90.48 |

*Primary Examiner*—E. Rollins Cross
*Assistant Examiner*—Weilun Lo
*Attorney, Agent, or Firm*—Robert J. Outland

[57] ABSTRACT

A roller valve lifter, especially of the hydraulic lash adjusting type for diesel engines, has an enlarged bronze roller shaft journal for extended wear with a diameter at least half that of the surrounding skirt of the lifter body within which it is mounted. The roller/shaft assembly is received in a recess through the open bottom end of the lifter body, the shaft having mounting tangs with flats which engage abutments in the recess to locate the roller in the recess. Retention is preferably by staking portions of the tangs into recesses in the skirt, preferably formed by openings adjacent the ends of the tangs.

12 Claims, 2 Drawing Sheets

ENLARGED SHAFT ROLLER LIFTER WITH RETENTION MEANS

TECHNICAL FIELD

This invention relates to valve lifters, or tappets, for internal combustion engines and, more particularly, to valve lifters of the roller follower type.

BACKGROUND

It is known in the art relating to roller valve lifters, particularly those used in diesel engines in highway trucks, to use a bronze shaft to journal the roller cam follower. The shaft is ordinarily pressed or staked into opposite openings of a transverse bore extending laterally through the roller end of the lifter to maintain the roller in a recess or pocket formed in and opening through the end of the lifter body. The recess is surrounded by a cylindrical portion of the body forming, in effect, a skirt for bearing against a bore of an associated lifter gallery.

In order to extend the wear life of such roller lifters, especially those used in diesel engines where soot in the lubricant may increase wear, use of a larger diameter bearing journal is desired. However, installation of the shaft through the transverse bore limits the shaft diameter to something less than one half the diameter of the associated lifter skirt.

SUMMARY OF THE INVENTION

The present invention provides mounting and retention means for a roller and shaft in a lifter skirt pocket or recess which permits the use of a larger diameter shaft providing increased bearing surface for improved wear life. The shaft is preferably of known deformable bronze bearing material although other materials, such as steel, ceramics and the like, might be used if found suitable. The shaft with the roller assembled thereon is installed in a preformed pocket from the open end of the lifter skirt and is preferably retained in place by staking although other suitable means, such as roll pins, retained in recesses, discontinuities or openings in is the skirt adjacent to the shaft ends may be used if desired.

With this form of end loaded roller shaft installation and retention, it is possible to use a larger diameter shaft of greater than one half the diameter of the associated lifter body skirt and up to seventy or more percent of the diameter of the roller.

These and other features and advantages of the invention will be more fully understood from the following description of certain specific embodiments of the invention taken together with the accompanying drawings.

BRIEF DRAWING DESCRIPTION

DETAILED DESCRIPTION

Figure 2:
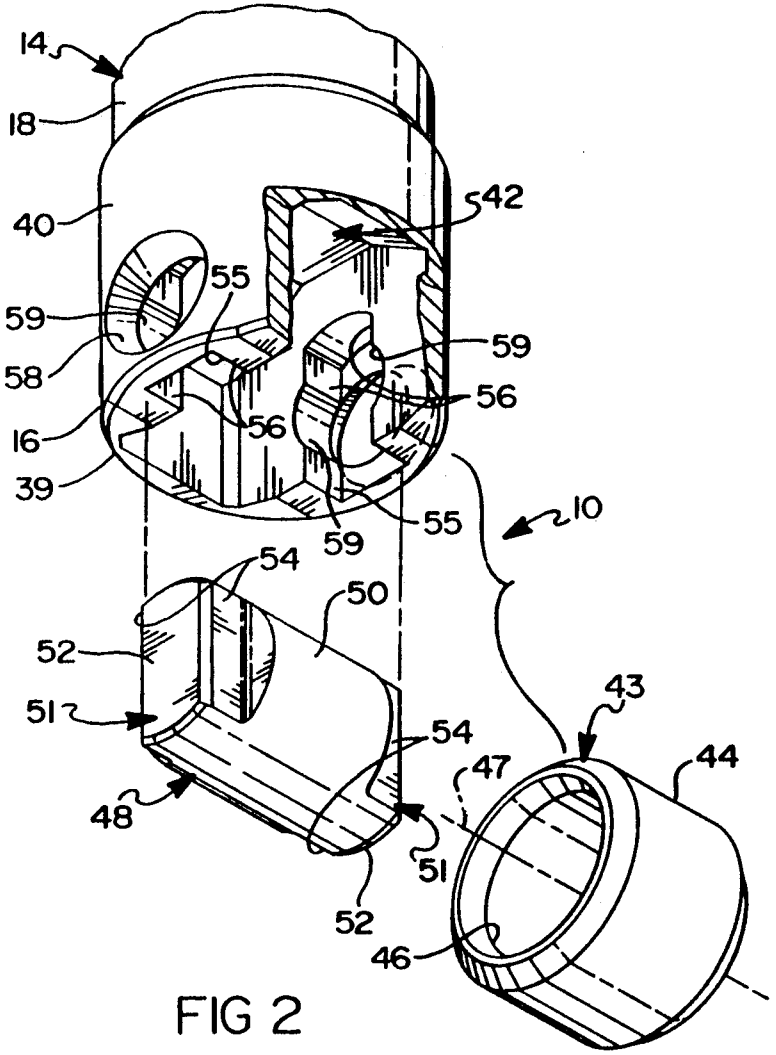
FIG. 2 is an exploded view of the roller follower portion of the valve lifter showing the manner of assembly.
Figure 1:
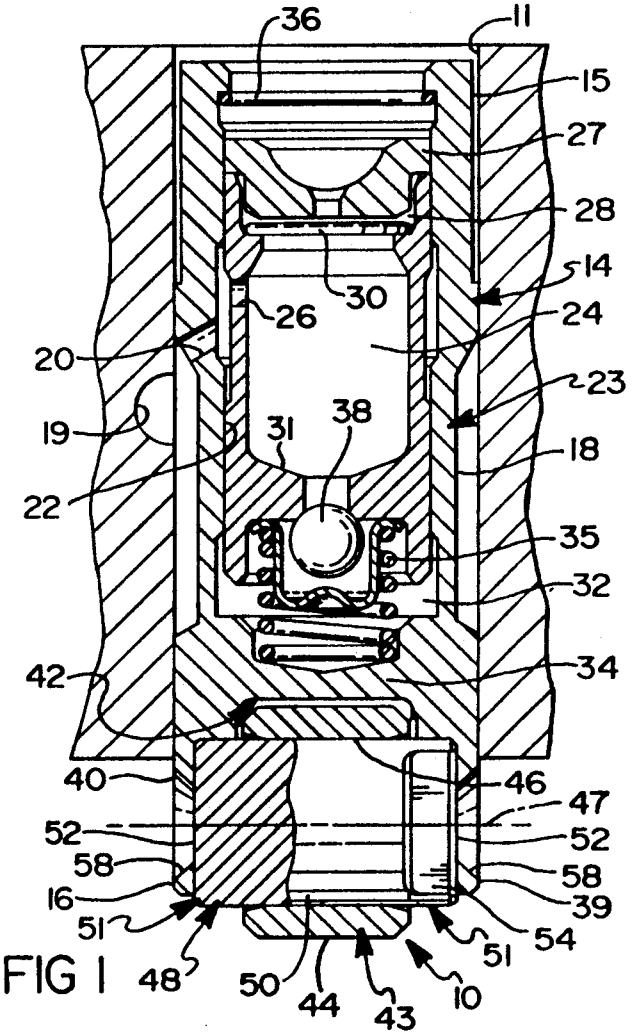
FIG. 1 is a longitudinal cross-sectional view of a roller hydraulic valve lifter in accordance with the invention disposed in an engine lifter gallery bore.
Figure 3:
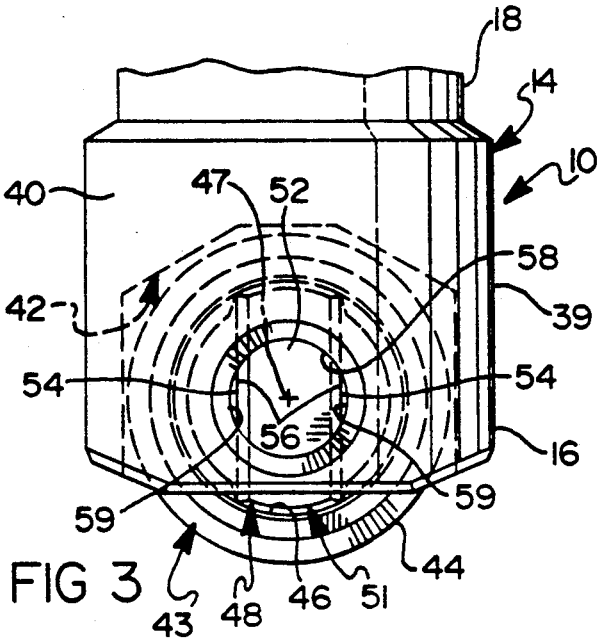
FIG. 3 is a side view of the roller end of the valve lifter.
Figure 4:
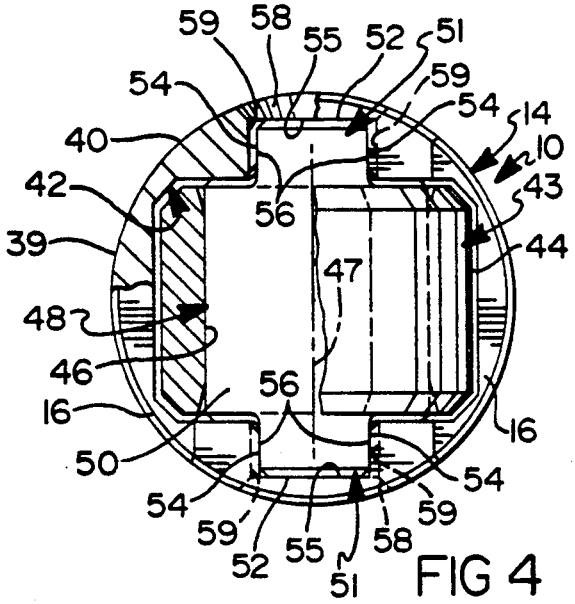
FIG. 4 is a roller end view of the valve lifter.

Referring now to the drawings in detail, numeral 10 generally indicates, for example, a roller hydraulic valve lifter although the invention may equally well be applied to mechanical or solid (non-lash adjusting) type valve lifters. Lifter 10 is reciprocably disposed in a bore 11 of an engine lifter gallery 12 of an engine block. The lifter 10 is reciprocated by a cam, not shown, to actuate valve mechanism through a conventional push rod, not shown.

The valve lifter 10 comprises a hydraulic lash adjusting valve lifter of known type having an elongated generally cylindrical body 14 with an upper end 15 and a lower end 16. The body includes an exterior annular oil groove 18 which receives oil from an oil gallery 19 connected to the pressure side of an engine oil lubricating system and communicating with the lifter gallery bore 11. An oil inlet passage 20 extends through the wall of the body 14 into an enlarged portion of a central cylinder 22 open through the upper end 15 of the body 14.

Within the cylinder 22, a hollow plunger 23 is reciprocable and defines an internal reservoir chamber 24 into which oil is delivered from the enlarged portion of the cylinder 22 through a port 26 in the plunger wall near the open upper end. An orificed push rod seat 27 is mounted on the open upper end of the plunger through which oil flow to the valve gear is controlled by a metering valve 28 in the form of a captured disk 30 engageable with the orificed lower end of the push rod seat 27. An orificed lower wall 31 of the plunger 23 separates the reservoir chamber 24 from a high pressure chamber 32 defined by the plunger and a bottom wall 34 of the body 14.

A plunger spring 35 urges the plunger upward to take up valve lash in known manner, travel being limited by a wire retainer 36 in the upper end of the body. A conventional caged ball check 38 allows oil flow through the orifice from the reservoir chamber 24 to the high pressure chamber 32 but prevents its return to provide a hydraulic column for actuating the associated valve gear.

Below the bottom wall 34, the lifter body 14 forms a skirt 39 having a cylindrical outer surface 40 engageable with the bore 11 of the lifter gallery. Within the skirt and opening through the bottom end of the body 14 is a roller pocket or recess 42 in which there is received a cam follower roller 43. The roller has a generally cylindrical or slightly barrel shaped round outer surface 44 and a coaxial bore 46 extending on an axis 47 transverse to the lifter body reciprocating motion. The roller outer diameter is about ¾ of the outer diameter of the skirt 39.

A bronze bearing shaft 48 extends through the roller bore and journals the roller on a central bearing journal 50 having an outer diameter slightly greater than half the outer diameter of the skirt 39. Opposite ends of the shaft 48 extend beyond the roller and form tangs 51 having axial outer ends 52 and laterally opposite flats 54. The ends 52 are received in transverse extensions 55 of the roller recess 42 which extend within the skirt wall and include laterally opposed abutments 56 which closely oppose the shaft flats 54 and centrally position the roller and shaft assembly within the recess 42.

In the preferred embodiments, the shaft tangs extend longitudinally of the lifter body 14 with the full diameter of the adjacent journal 50 while the flats 54 are formed by machining the lateral sides of the journal extensions to form the tangs 51. However, if desired, the longitudinal extent of the tangs could also be reduced as long as a sufficient length of the flats remains to properly locate and support the roller/shaft assembly.

It is considered important to maintain rigidity of the skirt that the lower edge thereof not be broken by the recess extensions or by the pocket (recess 42) for the roller outer diameter. Therefore, the recess 42 is contained completely within the skirt outer diameter, leaving sufficient wall thickness to provide the desired stiffness. The recess 42 is thus shaped with a generally rectangular configuration opening through the lower end of the body 14. This shape is modified by the transverse extensions 55 centrally from either side to receive and locate the tangs 51 of the shaft 48. The shape of the recess is such as to permit installation of the roller 43 together with and after assembly on the shaft journal 50 through the lower end 16 of the body, thereby allowing the use of a substantially larger shaft journal diameter than is possible when the shaft is installed through transverse holes in the skirt as is conventional.

In a preferred but not limiting embodiment, the ratios of the shaft journal diameter to that of the skirt outer wall and the roller outer surface are about 0.54 and 0.71, respectively. Comparatively, the diameter ratio of the roller to the skirt is about 0.76. Obviously, a reasonable range of shaft journal/skirt ratios greater than 0.5 is possible with the present invention, depending in part upon the selected roller outer diameter and the strength of the materials chosen from those that may be suitable for the operating conditions. In the present instance a shaft journal/skirt ratio range from 0.50 to 0.65 appears practical with the other ratios being adjusted accordingly.

Finally, it is necessary to provide means for retaining the shaft/roller assembly in place in the recess 42 after installation in the body 14 both to provide for integrity of the assembly during operation and during shipping and handling prior to installation in an engine. Numerous possible alternatives for this purpose may be reasonably utilized including clips, spring pins or press fitted means extending through or into openings or recesses in the skirt and associated tangs of the shaft. While within the scope of the invention, these alternatives add additional components to the assembly which, in general, tend to increase its cost and complexity as well as the chance of loosening of these elements causing a problem in service.

Accordingly, the preferred practice, capable of use with selection of a deformable shaft material such as bronze, is to stake or deform a portion of the tangs into recesses or openings in the skirt adjacent the tangs. In the embodiment of FIGS. 1–4, these recesses are formed by cross drilled and counterbored or chamfered holes 58 through the skirt opposite the ends 52 of the tangs 51. The holes form curved recesses 59 into which adjacent portions of the tangs are staked by deforming the ends of the tangs with a staking tool.

Figure 5:
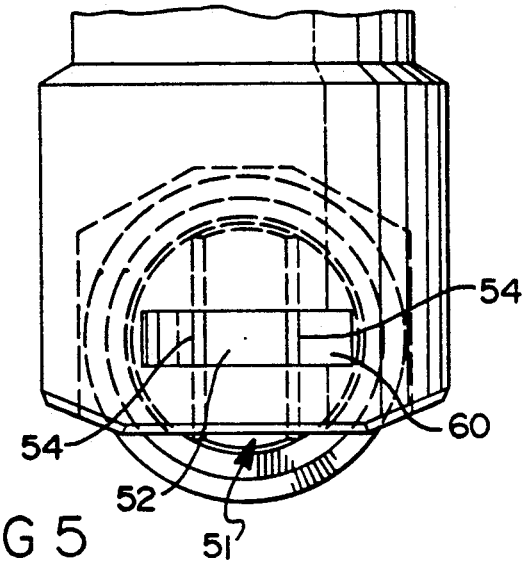
FIG. 5 is a side view similar to FIG. 3 but showing an alternative embodiment of valve lifter according to the invention.

In the alternative embodiment of FIG. 5, laterally elongated through slots 60 are provided which extend inward opposite portions of the flats 54 near the ends 52 of the tangs 51. Adjacent portions of the tangs are staked into the slots to retain the shaft in a fixed position. Obviously other forms of openings through the skirt or recesses within the skirt may be provided if desired.

While the invention has been described in part by reference to certain preferred embodiments, it should be understood that numerous changes or modifications could be made within the spirit and scope of the inventive concepts described. Accordingly the invention should not be limited to the disclosed embodiments but should be given the full scope permitted by the language of the following claims.

What is claimed is:

1. A roller valve lifter comprising a cylindrical body having opposite first and second ends, a recess having a central opening through the first end and contained within a surrounding skirt having a cylindrical outer surface, a cam follower roller received in the recess, the roller having a round outer surface and a concentric bore centered on an axis transverse to the skirt, a bearing shaft having a cylindrical journal extending through the bore and journaling the roller for rotation thereon, the shaft having opposite ends extending axially beyond the roller and each defining an integral mounting tang having an outer end and laterally opposite flattened sides, the tangs fitting closely within tang receiving extensions of the roller recess along the transverse axis and having lateral abutments opposing the flattened sides of the tangs to locate the shaft in the recess with the roller centered and extending partly beyond the body first end, the central opening of the recess including the extensions being configured to permit installation of the shaft with the roller assembled thereon through the first end of the bod into the recess, the shaft being formed of a deformable bearing material, and means for retaining the shaft in the recess extensions, said retaining means comprising through openings in the skirt adjacent the outer ends of the tangs, the outer ends having portions deformed after instalation in the body into engagement with edges of the through openings to retain the shaft and roller in their installed locations in the recess.

2. A roller valve lifter as in claim 1 wherein the shaft is made of bronze.

3. A roller valve lifter as in claim 2 wherein the through openings are round.

4. A roller valve lifter as in claim 2 wherein the through openings are elongated slots.

5. A roller valve lifter as in claim 1 wherein the lifter comprises a hydraulic valve lifter.

6. A roller valve lifter comprising, a cylindrical body having opposite first and second ends, a recess having a central opening through the first end and contained within a surrounding skirt having a cylindrical outer surface, a cam follower roller received in the recess, the roller having a round outer surface and a concentric bore centered on an axis transverse to the skirt, a bearing shaft having a cylindrical journal extending through the bore and journaling the roller for rotation thereon, the shaft having opposite ends extending axially beyond the roller into the recess along the transverse axis to locate the shaft in the recess with the roller centered and extending longitudinally partly beyond the body first end, the central opening of the recess being configured to permit installation of the shaft with the roller assembled thereon through the first end of the body into the recess, and means for retaining the shaft in the recess, the shaft retaining means comprising portions of the shaft ends staked into discontinuities of the body skirt.

7. A roller valve lifter as in claim 6 wherein the diametral ratio of the cylindrical shaft journal to the outer surface of the body skirt is not less than 0.5.

8. A roller valve lifter as in claim 6 wherein the diametral ratio of the cylindrical shaft journal to the outer surface of the roller is not less than 0.6.

9. A roller valve lifter as in claim 6 wherein the diametral ratios of the cylindrical shaft journal to the outer surfaces of the body skirt and to the roller are not less than 0.5 and 0.65, respectively.

10. A roller valve lifter as in claim 6 wherein the diametral ratio of the cylindrical shaft journal to the outer surface of the body skirt is in the range from 0.5 to 0.6.

11. A roller valve lifter as in claim 6 wherein the discontinuities comprise openings through the skirt adjacent the ends of the shaft.

12. A roller valve lifter as in claim 6 wherein the shaft ends define tangs having oppositely facing flats opposing abutments in the skirt and the skirt openings form recesses in the abutments into which portions of the flats are staked.

* * * * *